US008813275B2

(12) United States Patent
Genova

(10) Patent No.: US 8,813,275 B2
(45) Date of Patent: Aug. 26, 2014

(54) SPA COVER

(75) Inventor: Michael C. Genova, Spokane, WA (US)

(73) Assignee: Leisure Concepts, Inc., Spokane, WA (US)

( * ) Notice: Subject to any disclaimer, the term of this patent is extended or adjusted under 35 U.S.C. 154(b) by 442 days.

(21) Appl. No.: 13/317,712

(22) Filed: Oct. 26, 2011

(65) Prior Publication Data

US 2013/0104307 A1 May 2, 2013

(51) Int. Cl.

| | |
|---|---|
| ***E04H 4/00*** | (2006.01) |
| ***E04H 4/08*** | (2006.01) |
| ***A61H 33/00*** | (2006.01) |
| *A61H 33/02* | (2006.01) |

(52) U.S. Cl.

CPC ..... *A61H 33/60* (2013.01); *E04H 4/084* (2013.01); *A61H 33/02* (2013.01); *A61H 33/0087* (2013.01)

USPC ..... 4/498

(58) Field of Classification Search

CPC ..... E04H 4/143

USPC ..... 4/488–513

See application file for complete search history.

(56) References Cited

U.S. PATENT DOCUMENTS

| | | | | |
|---|---|---|---|---|
| 5,685,032 | A * | 11/1997 | Watkins et al. | 4/506 |
| 5,996,137 | A * | 12/1999 | Genova | 4/498 |
| 6,842,917 | B1 * | 1/2005 | Genova | 4/498 |
| 7,225,479 | B2 * | 6/2007 | Katt | 4/498 |
| 8,468,617 | B2 * | 6/2013 | Gardenier et al. | 4/498 |
| 2003/0037370 | A1 * | 2/2003 | Cato | 4/498 |
| 2003/0150054 | A1 * | 8/2003 | Tudor | 4/498 |
| 2003/0167564 | A1 * | 9/2003 | LaHay | 4/498 |
| 2006/0053543 | A1 * | 3/2006 | Vargas et al. | 4/498 |
| 2006/0230513 | A1 * | 10/2006 | Cunerty | 4/498 |
| 2007/0079434 | A1 * | 4/2007 | Pellerin | 4/498 |
| 2007/0107118 | A1 * | 5/2007 | Tudor | 4/498 |
| 2007/0209104 | A1 * | 9/2007 | Buzzetti et al. | 4/498 |
| 2007/0210290 | A1 * | 9/2007 | Koren | 254/264 |
| 2008/0060125 | A1 * | 3/2008 | Koren | 4/498 |
| 2008/0244820 | A1 * | 10/2008 | Moore | 4/498 |
| 2009/0025135 | A1 * | 1/2009 | Huber | 4/498 |
| 2009/0126097 | A1 * | 5/2009 | Kanetis | 4/503 |
| 2009/0313751 | A1 * | 12/2009 | Livingston | 4/498 |
| 2010/0011498 | A1 * | 1/2010 | Coleman et al. | 4/498 |
| 2010/0313352 | A1 * | 12/2010 | Sloss | 4/498 |
| 2011/0088157 | A1 * | 4/2011 | Young | 4/498 |
| 2011/0239360 | A1 * | 10/2011 | Gramatikopoulos | 4/498 |
| 2012/0005818 | A1 * | 1/2012 | Coelho | 4/493 |
| 2012/0066828 | A1 * | 3/2012 | Kite | 4/498 |
| 2013/0031713 | A1 * | 2/2013 | Kite | 4/498 |
| 2013/0104307 | A1 * | 5/2013 | Genova | 4/498 |
| 2013/0117922 | A1 * | 5/2013 | Spicer | 4/498 |
| 2014/0000021 | A1 * | 1/2014 | Scheps et al. | 4/498 |
| 2014/0020170 | A1 * | 1/2014 | Timischl | 4/498 |

* cited by examiner

*Primary Examiner* — Lori Baker

(74) *Attorney, Agent, or Firm* — Paine Hamblen, LLP

(57) ABSTRACT

A spa cover is described and which includes first and second rigid portions joined together by a continuous hinge and which each define a multiplicity of spaced, uniformly elongated internal channels extending between opposite peripheral edges thereof; individual lightweight unitary insulative inserts are dimensioned for telescoping receipt within each of the internal channels which are defined by the respective first and second portions, a pair of brackets are mounted on the spa, and which define, at least in part, a course of travel for the spa cover so as to expose the spa for use; and a generally U-shaped carrier is rotatively affixed to the pair of brackets and which cooperates with the second portion of the spa cover.

5 Claims, 6 Drawing Sheets

SPA COVER

TECHNICAL FIELD

The present invention relates to a spa cover, and more specifically to a fluid impermeable spa cover which avoids many of the detriments associated with the prior art devices utilized heretofore.

BACKGROUND OF THE INVENTION

Covers for spas, or so-called "hot tubs" have been utilized for decades. These covers are often employed in cooler climates to minimize the escape of heat energy from the spa. Further, they are often employed to cover the spa to prevent unauthorized access, or to prevent debris, such as dust, leaves, insects and the like from being deposited in the hot tub.

Heretofore, spa covers having two portions have usually been fabricated from rigid, lightweight insulative sheets which have been typically enclosed in a flexible synthetic sheet or envelope. The two portions are typically joined together by a hinge. In most covers, the hinge is formed by a seam of flexible material which bridges between the two halves or portions. It has been common practice to remove such prior spa covers by swinging or moving one-half of the cover onto the remaining cover half, and then lifting both halves from the spa. As described in various prior art references, this task of removing a spa cover has often been difficult because of the awkwardness of the spa cover construction, and further due to the weight of the spa covers as these same spa covers have become heavier, over time, due to the absorption of water because of their proximity to the underlying spa, or because water is absorbed from the ambient environment.

Spa owners have long understood that spa covers having the prior art construction must be periodically replaced because such spa covers become water logged, and thereafter become too difficult to handle. Further these water-logged spa covers encourage the growth of mold, mildew and other undesirable organisms.

In addition to the foregoing, the prior art spa covers often deteriorate, over time, in view of the fact that they are often directly exposed to the immediate environment. Therefore sunlight and other environmental conditions rapidly deteriorate or weaken the construction of the spa covers such that they must be periodically replaced, for example, every three to five years. Because these prior art spa covers are replaced on a rather frequent basis, the manufacturers of same have endeavored to keep the cost of manufacturing such covers to a minimum. However, the motivation to keep the price point of such products at a level that encourages the periodic purchase by a spa owner does not motivate the manufacturers to use high quality materials which will resist the aforementioned environmental degradation, or the absorption of water which is occasioned by the proximity of the spa cover to the underlying heated water enclosed within the spa.

In addition to the shortcomings noted above, and in some colder climates, and especially where spas are maintained in outside, uncovered areas, difficulties result from a spa owner having to remove, for example snow, from the top of the spa following a snowstorm. In some cases, spas are quite large and to remove snow effectively from such spa covers requires that the spa owner elevate themselves to a position where they can reach regions of the spa cover outside of their normal arm's length. Such removal of snow is often quite difficult, and in view of the construction of the prior art spa covers used heretofore, such spa covers will occasionally not support both the weight of a normal person, and the load of snow such that all regions of the spa cover can be effectively cleared of snow.

A spa cover which addresses these other shortcomings associated with the prior art spa covers which were utilized, heretofore, is the subject matter of the present patent application.

SUMMARY OF THE NEW INVENTION

A first aspect of the present invention relates to a spa cover which includes a first and second rigid and substantially fluid impermeable portion each having peripheral edges, and which are moveably joined to each other along one of their respective peripheral edges by a hinge, and wherein each portion of the spa cover defines a multiplicity of spaced, uniformly elongated internal channels which extend between a pair of the opposite, peripheral edges; individual, light weight, unitary, insulative inserts which are conformably dimensioned for telescoping receipt within each of the elongated internal channels defined by the respective first and second portions of the spa cover; a pair of brackets mounted on a spa, and which define, at least in part, a course of travel for the first and second portions of the spa cover as the first and second portions move in substantial unison, together to expose the spa for use; and a generally U-shaped carrier rotatably affixed to the pair of brackets and which cooperates with the second portion of the spa cover, and wherein the U-shaped carrier carries the first and second portions of the spa cover along the course of travel and which permits the underlying spa to be exposed for use.

Another object of the present invention is to provide a spa cover which includes a first and second portion which are joined to each other by a hinge, and which are further disposed in a substantially horizontal relationship, and are coplanar, one, relative to the other, when both portions are covering an underlying spa when it is not in use, and wherein the first portion of the spa top is movable by means of the continuous hinge relative to the second portion so as to partially expose the spa, and wherein, when the spa is partially exposed, the first portion rests in a juxtaposed, substantially horizontal, covering relationship relative to the second portion, and wherein the first and second portions are then moveable, in unison, from a substantially horizontal and juxtaposed orientation, where only a portion of the spa is uncovered, to a substantially vertical orientation, where the spa is completely exposed, and wherein each portion of the spa includes a rigid, substantially fluid impermeable top and bottom surface, and opposite, peripheral edges, and wherein each portion of the spa cover defines a multiplicity of spaced, narrowly elongated internal channels which extend between the opposite peripheral edges; a multiplicity of rigid, light weight, unitary, insulative inserts which are individually conformably shaped for mating, telescoping receipt within the respective narrowly elongate internal channels defined by the respective first and second portions of the spa cover, and wherein the respective rigid, insulative inserts are fabricated from a synthetic, closed pore material which substantially resists the absorption of water therein, and which further are effective in retaining, within the spa, heat energy which is generated by the spa during operation, and when the spa cover is disposed in covering relation relative to the spa; a pair of substantially peripheral edge covers which are removably coupled in covering relation relative to the opposite peripheral edges of the respective first and second portions of the spa cover, and wherein the respective peripheral edge covers substantially occlude the respective narrowly elongated internal channels, and substantially sealably retain the individual insulative inserts therein, and wherein the respective peripheral edge covers can be selectively removed, and selective internal insulative inserts removed, and then replaced, following the installation of the spa cover on the spa, in the event the individual insulative inserts becomes damaged, contaminated and/or otherwise do not effectively insulate the spa; a pair of brackets mounted on the spa, and which define a lift axis for the spa cover when the first and second portions of the spa cover are moving in unison from a substantially horizontal orientation, where the respective spa covers partially cover the spa, to a substantially vertical orientation, where the spa is completely exposed; a generally U-shaped carrier rotatably affixed to the respective pair of brackets, and which forcibly engages and cooperates with the respective first and second portions of the spa cover, and which is operable to carry the respective first and second portions of the spa cover which are disposed in juxtaposed relation, one relative to the other, from the a horizontal position, where the spa is partially covered, to a vertical position, where the spa is uncovered, and back again, and wherein the U-shaped carrier includes a cross member which is located in a closely adjacent and spaced relationship relative to the hinge, and is further received at least in part within at least one of the elongated channels defined by the second portion of the spa cover; and a seal mounted on the bottom surface of the respective first and second portions of the spa cover and which are located so as to sealably engage the underlying spa when the first and second portions are oriented in a substantially horizontal and coplanar orientation one relative to the other.

The above and still further objects and advantages of the present invention will become apparent from the following description.

BRIEF DESCRIPTION OF THE DRAWINGS

Preferred embodiments of the invention are described below with reference to the following accompanying drawings.

DETAILED DESCRIPTION OF THE PREFERRED EMBODIMENT

This disclosure of the invention is submitted in furtherance of the constitutional purposes of the U.S. patent laws to promote the progress of science and useful arts. [Article I, Section 8]

Figure 1:
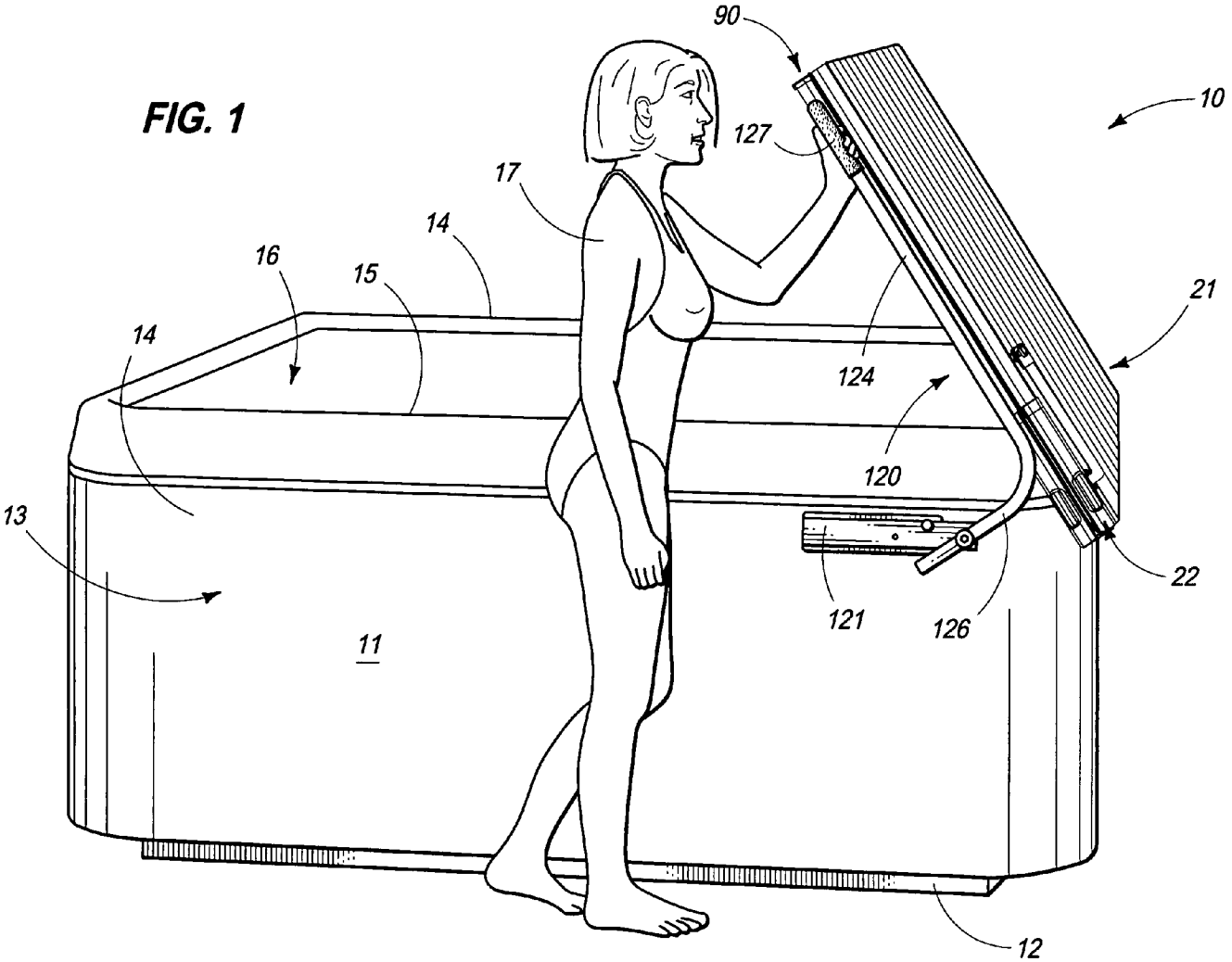
FIG. 1 is a perspective, environmental view showing the spa cover of the present invention, and which is employed in combination with a lift for the same spa cover.

An example of a spa cover incorporating the features of the present invention is generally designated by the numerical 10 in FIG. 1, and following. The spa cover 10 of the present invention is utilized in combination with a spa, or hot tub 11 of conventional construction. Such spas include a bottom supporting surface 12 which rests on an underlying surface such as the surface of the earth, a deck or similar surface, not shown. The bottom surface 12 has a peripheral edge. Extending substantially normally upwardly relative to the bottom surface 12 is a substantially continuous, and fluid impervious sidewall 13. In the arrangement as shown in the drawings, the spa 11 is substantially rectangularly shaped, and has opposite sidewall portions 14 which are made integral with the continuous sidewall 13. Other spa shapes are of course available. The continuous sidewall 13 as illustrated has an upper peripheral edge 15. The spa 11 has a spa cavity 16 which encloses a volume of water, which is heated by the spa 11, to a given temperature which is determined by a user 17.

The spa cover 10 as depicted, is substantially rectangular. The spa cover 10 is designed to compliment the shape of the underlying spa 11, and to rest on the spa top or upper peripheral edge 15 of the continuous sidewall 13 in a covering, substantially sealing orientation. Additionally it will be understood that the spa cover provides an insulative surface to protect the water contained therebelow, and to further retain the heat energy generated by the spa so as to maintain the water enclosed in the spa at a given temperature. Still further, the spa cover provides an effective means to prevent unauthorized access, or debris such as leaves, dust, insects and the like from being deposited within the spa cavity 16.

Figure 2:
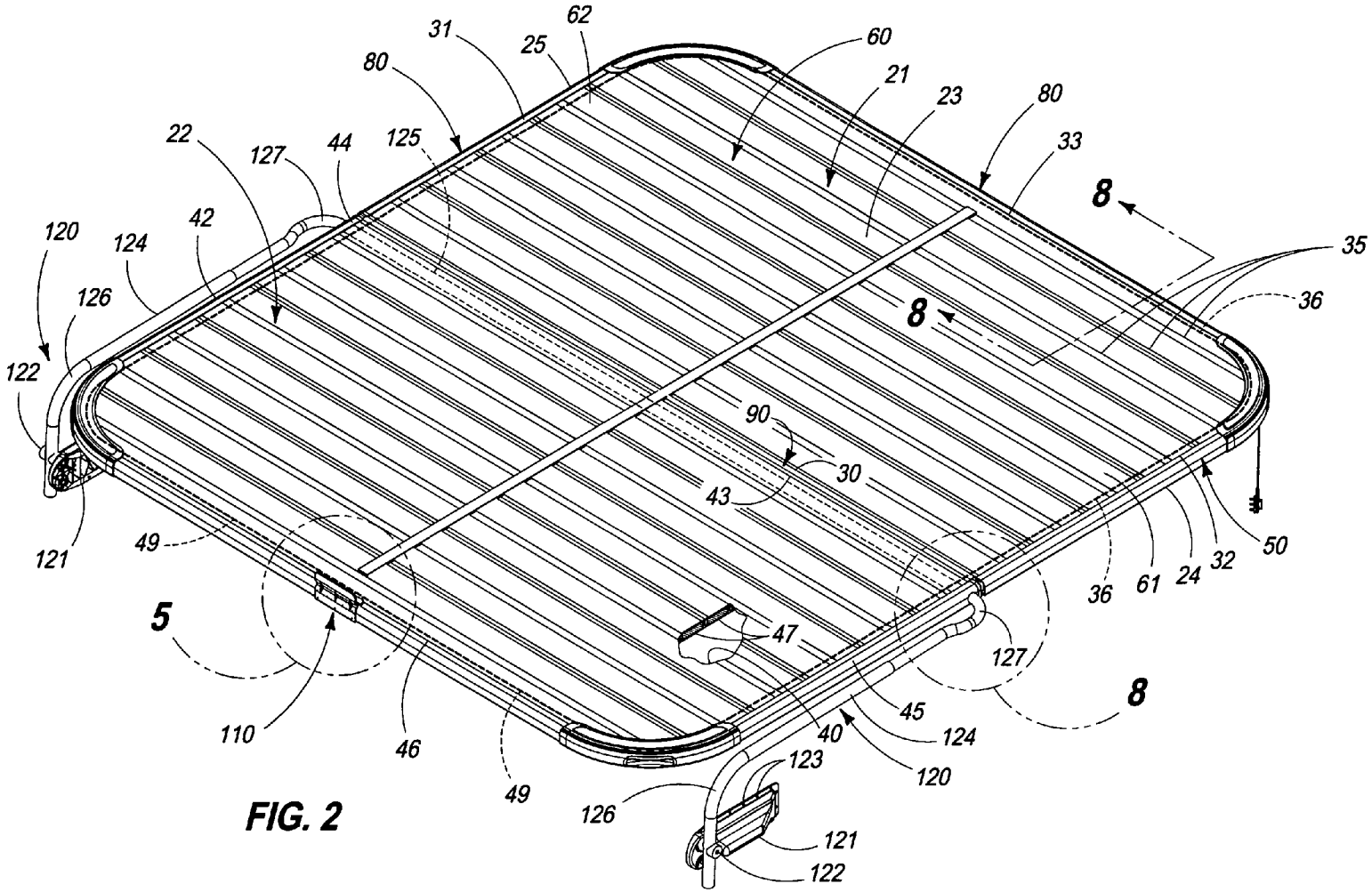
FIG. 2 is a perspective top plan view of the spa cover of the present invention.
Figure 8:
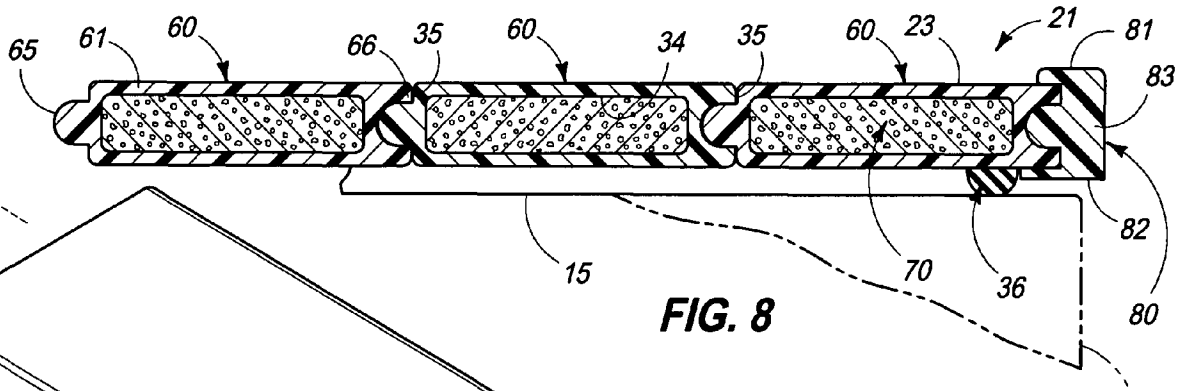
FIG. 8 is a transverse vertical sectional view taken from a perspective along lines 8-8 of FIG. 2.

As seen in the drawings, the spa cover 10 is fabricated from first and second portions which are generally indicated by numerals 21 and 22, respectively. With regard to the first portion 21, the first portion 21 of the spa cover 10 has a top surface 23, and an opposite, bottom surface 24. Still further, the first portion is defined, generally, by a peripheral edge 25. The peripheral edge further has an inwardly facing or abutting peripheral edge portion 30; first and second laterally disposed peripheral edges 31 and 32, respectively; and an outwardly disposed peripheral edge which is generally indicated by the numeral 33. As seen in FIGS. 2 and 8, the first portion 21 includes a multiplicity of spaced, narrowly elongated internal channels 34 (FIG. 7) which extend between the opposite, first and second lateral, oppositely oriented peripheral edges 31 and 32, respectively. It should be understood that the top and bottom surface 23 and 24, respectively, each have a thickness dimension of at least around 0.5 inches and are otherwise substantially fluid impermeable. This feature of the present invention will be discussed in greater detail below. As seen in the attached drawings, the top and bottom surface may be formed or manufactured in a manner to produce individual or multiple corrugations 35 therein (FIG. 8). These corrugations increase the strength of the first portion 21. Attached to the bottom surface 24 of the first portion 21, and located adjacent to the peripheral edge 25 is a flexible seal 36. The seal 36 is operable to conformingly, and matingly engage the upper peripheral edge 15 of the underlying spa 11 in a manner so as to provide a reliable seal which substantially impedes the escape of water vapor, and heat energy from the spa cavity 16 when the first portion of the spa cover 21 is positioned in a substantially horizontal and coplanar relationship relative to the second portion of the spa 22, (FIG. 2).

Figure 6:
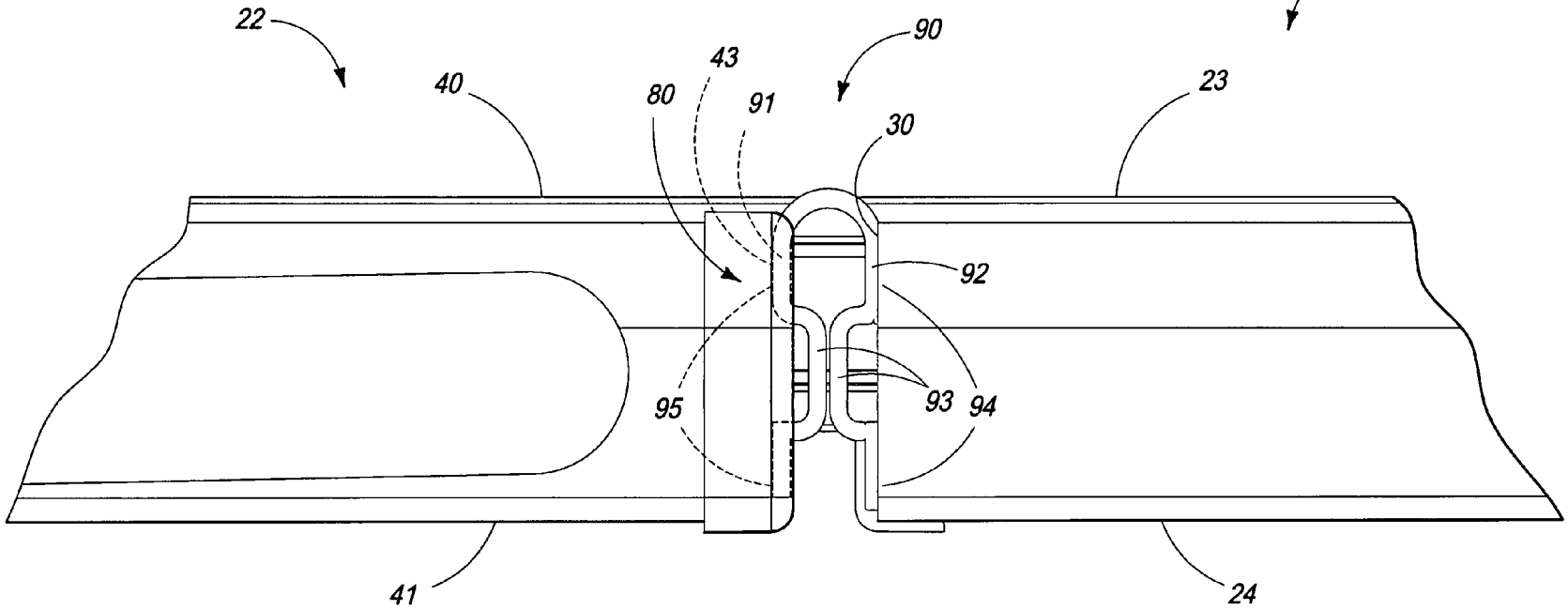
FIG. 6 is a greatly enlarged side elevation view of a portion of the spa cover showing the continuous hinge which is employed the same.

The second portion 22 of the spa cover 10 is very similar in construction to that provided by the first portion 21, that being, that the second portion 22 has a top and bottom surface 40 and 41 respectively, which have a given thickness dimension which makes these respective surfaces substantially fluid impermeable. Still further, the second portion 22 has an outer peripheral edge 42 which is defined, in part, by an inwardly facing, and abutting peripheral edge 43 which is located in spaced, substantially parallel relation relative to the inwardly facing and abutting peripheral edge 30 of the first portion 21. This is best seen in FIG. 6. The outer peripheral edge 42 is further defined by first and second laterally disposed peripheral edge portions 44 and 45, respectively, and an outwardly disposed peripheral edge 46 which is substantially opposite to the outwardly disposed peripheral edge 33, of the first portion 21. Again, the top and bottom surfaces 40 and 41, of the second portion 22, have a multiplicity of narrow rectangular and internal channels 47 (FIG. 8). These narrow, internal channels 47 extend between the opposite first and second laterally disposed peripheral edges 44 and 45, respectively. These narrow channels 47 are disposed in predetermined spaced relationship, one relative to the others. Additionally, the top and bottom surfaces each have formed therein corrugations 48 (FIG. 7), which increases the strength of these particular surfaces. Again, as with the first portion 21, a seal 49 is provided and which is attached to the bottom surface 41, and which is disposed in a closely adjacent relationship relative to the outer peripheral edge 42. This seal is operable to resiliently and matingly engage the upper peripheral edge 15 of the continual sidewall 13 forming the spa 11. This seal is operable to prevent the escape of water vapor, and heat energy generated by the spa 11 during its operation.

Figure 7:
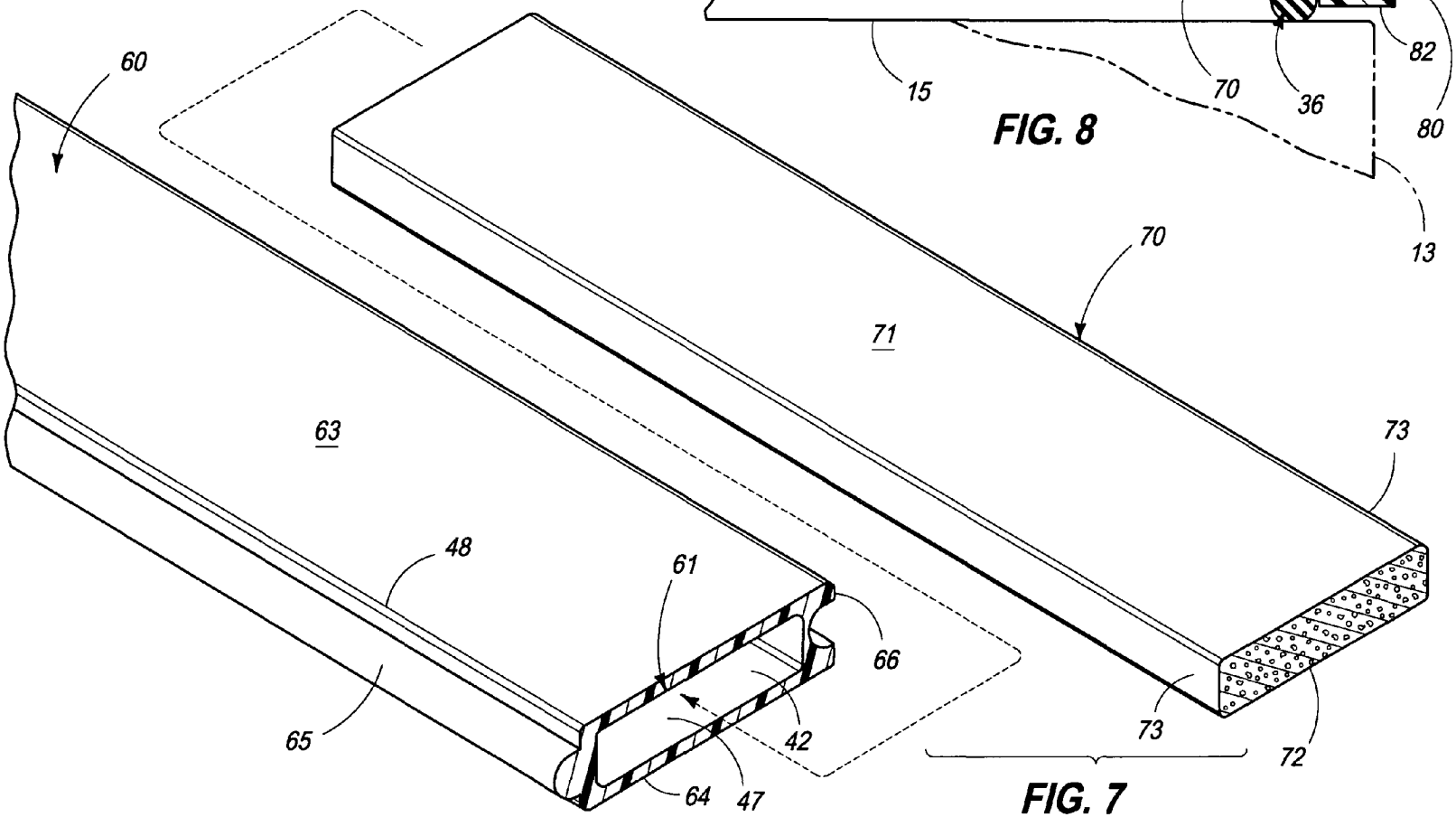
FIG. 7 is a fragmentary, exploded, perspective view showing a portion of the construction of the spa cover of the present invention.

The spa cover 10 of the present invention, and more specifically the first and second portions 21 and 22, thereof, are each formed from a multiplicity of rigid, tongue-in-groove hollow, synthetic boards which are generally indicated by the numeral 60 (FIGS. 7 and 8). While one board is described in significant detail herein, it should be understood that the respective first and second portions 21 and 22 are formed of multiple boards 60 in the fashion as will be described. As best seen by references to FIGS. 2 and 8, the respective tongue and groove, hollow, synthetic boards have opposite first and second ends 61 and 62, and further each have a top and bottom surface 63 and 64 respectively. Additionally, the hollow synthetic boards 60 have a leading, peripheral edge 65 which is formed into a tongue like shape, and further each have a trailing, peripheral edge 66 defining a groove which is dimensioned to receive the leading peripheral edge 65 of an adjacent hollow synthetic board 60. In the arrangement as seen in the drawings, the respective tongue and groove, hollow synthetic boards are affixed together by means of screws, adhesives, chemical bonding, welding or other conventional fastening techniques. Still further, when fully assembled, the first and second portions 21 and 22 can support a weight of at least about 112 pounds per square foot of surface area. This will, of course, allow for the support of a significant snow load, and will further prevent the spa cover from caving in, or being forcibly deflected or seriously damaged if a user was to stand on same. Still further, the spa cover 10 when fully assembled, has an insulative R rating of greater than about 8.

Therefore, it will be understood that the first and second portions 21 and 22 can be easily moved about from a first position where the first and second spa covers are in a substantially coplanar orientation, one relative to the other, and which are operable to completely occlude the spa cavity 16 thereby preserving the spa water, not shown, in a heated state and/or to otherwise preventing dust and other debris from being deposited within the spa caving 16. As will be discussed in further detail below, this assembled weight of the first and second portions 21 and 22 allows the spa cover 10 of the present invention to be easily moved to a position whereby the spa 11 is uncovered and can be enjoyed by the user 17. In the arrangement as shown in FIGS. 7 and 8, the respective synthetic hollow boards 60 are fabricated from any of the group of materials which include polyvinyl chloride, polyurethane, polypropylene and ABS. Still further, the top and bottom surfaces of the respective synthetic boards 60 each have a thickness dimension which is greater than about 0.05 inches. As seen in the drawings, the respective synthetic boards 60 may be formed by various molding techniques in order to produce a synthetic board 60 having the narrowly rectangular interior channel 34 and 47 respectively and which are operable to receive an insulated insert as will be described in the paragraph which follows. As currently seen in the drawings, the multiplicity of rigid tongue and groove hollow synthetic boards 60 are substantially fluid impermeable. This substantially prevents water, or water vapor coming from either the ambient environment, or from the underlying hot tub 11, from penetrating and being received within the multiplicity of narrow interior channels 34 and 47 which are defined by the respective hollow synthetic boards 60 forming the first and second portions 21 and 22, respectively.

As best understood by reference to FIGS. 2 and 8, individual, lightweight unitary closed pore insulative inserts 70 are provided, and which are conformably dimensioned for telescoping receipt within each of the elongated internal channels 34 and 47, which are defined by the respective first and second portions 21 and 22 of the spa cover 10. The closed pore insulative material forming the respective insulative inserts 70 substantially resists the absorption of water therein, and are effective in retaining within the spa 11 heat energy which is generated by the spa during operation and when the spa cover 10 is disposed in covering relation relative to the entire spa cavity 16. The closed pore insulative inserts have a weight about 165 pounds per cubic foot. As seen in FIGS. 2 and 8, the multiplicity of rigid, light weight unitary insulative inserts 70 have a top surface 71, an opposite bottom surface 72 and a peripheral edge 73. The respective insulative inserts are designed for close fitting receipt within the respective narrowly rectangular interior channels 34 and 47, respectively, thereby minimizing the amount of air space present in same, and thus increasing the individual insulative effect of the assembled spa cover 10. In the present arrangement, and in the event that the individual insulative inserts degrade, or further become unserviceable due to the constant exposure of the spa cover 10 to the surrounding ambient environment, the respective insulative inserts 70, because of their unitary construction, can be removed (post-installation) from the respective narrow interior channels 34 and 47 and then replaced with new insulative inserts. This allows a user 17 to maintain the resulting spa cover 10 in an optimal operating condition. The respective closed pore, rigid, lightweight, insulative inserts are fabricated from the group of materials which include polystyrene; polyethylene and polyurethane. As earlier noted, when fully assembled, the spa cover 10 has an insulative R rating of greater than about 8.

Peripheral edge covers which are generally indicated by the numeral 80 are provided, and which are removably coupled in covering relation relative to the opposite peripheral edges 30 through 34, and 43 through 46 of the first and second portions 21 and 22 of the spa cover 10. The respective peripheral edge covers substantially occlude the respective narrowly elongated internal channels 34 and 47, and substantially seal and retain the individual insulative inserts 70 therein. As earlier discussed, the respective peripheral edge covers 80 can be selectively removed and the internal insulative inserts 70 removed, and then replaced, if necessary, following the installation of the spa cover 10 on the spa 11. This would be done in the event that the individual insulative inserts 70 became damaged, contaminated, or otherwise did not effectively insulate the underlying spa cavity 60. The peripheral edge covers 80 have a top flange portion 81, a bottom flange portion 82, and an outwardly facing edge portion 83 which couples or joins the top and bottom portions together. The flange covers 80 may be affixed to the first and second portions 21 and 22 by using conventional fastening means which may include adhesives, threaded fasteners, and other means well known in the art.

Figure 4:
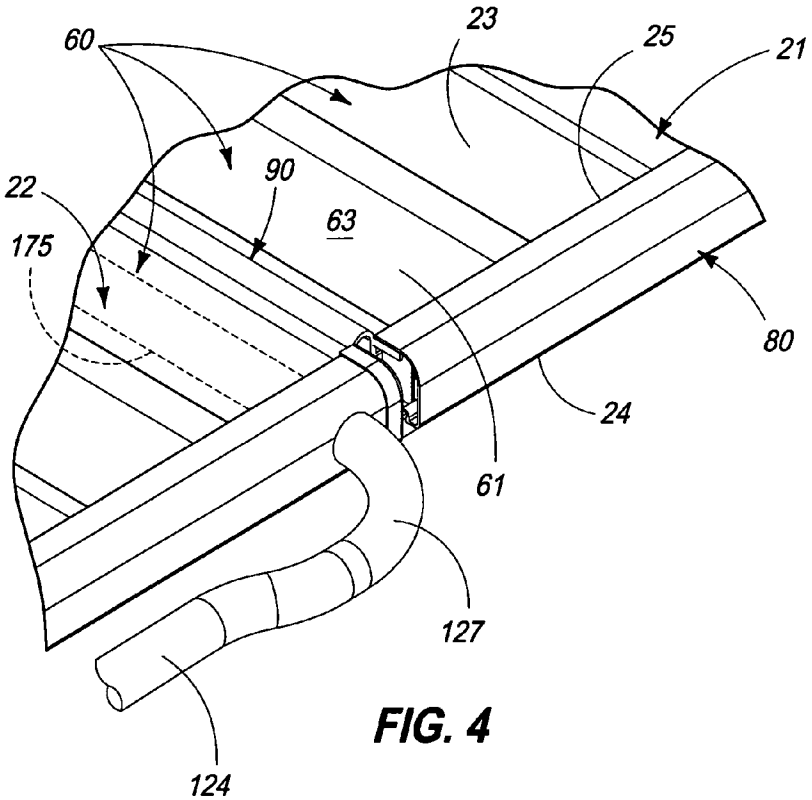
FIG. 4 is a partial, fragmentary, perspective view of the spa cover of the present invention.

The first and second portions 21 and 22 are joined at their inwardly facing or abutting peripheral edges 30 and 43, respectively, by means of a continuous flexible hinge 90 (FIGS. 4 and 6). The continuous flexible hinge 90 which is fabricated from a synthetic material has a first, downwardly depending leg portion 91, and a second leg portion of similar design 92, and which is spaced, therefrom. Each of the first, and second downwardly depending legs 91, and 92, have inwardly extending seal engaging members 93, which are operable to sealably mate thereagainst each other, thereby impeding the escape of water vapor or heat energy from the underlying water contained within the spa cavity 16. Additionally, as will be seen by a study of FIG. 8, the first and second downwardly depending legs 91 and 92 respectively have an exterior facing portion 94 and 95, respectively, which are individually affixed, by conventional fastening means such as by an adhesive, screw fasteners or the like, to the inwardly facing and abutting peripheral edges 30 and 43 which are made integral with the respective first and second portions 21 and 22, respectively.

Figure 3:
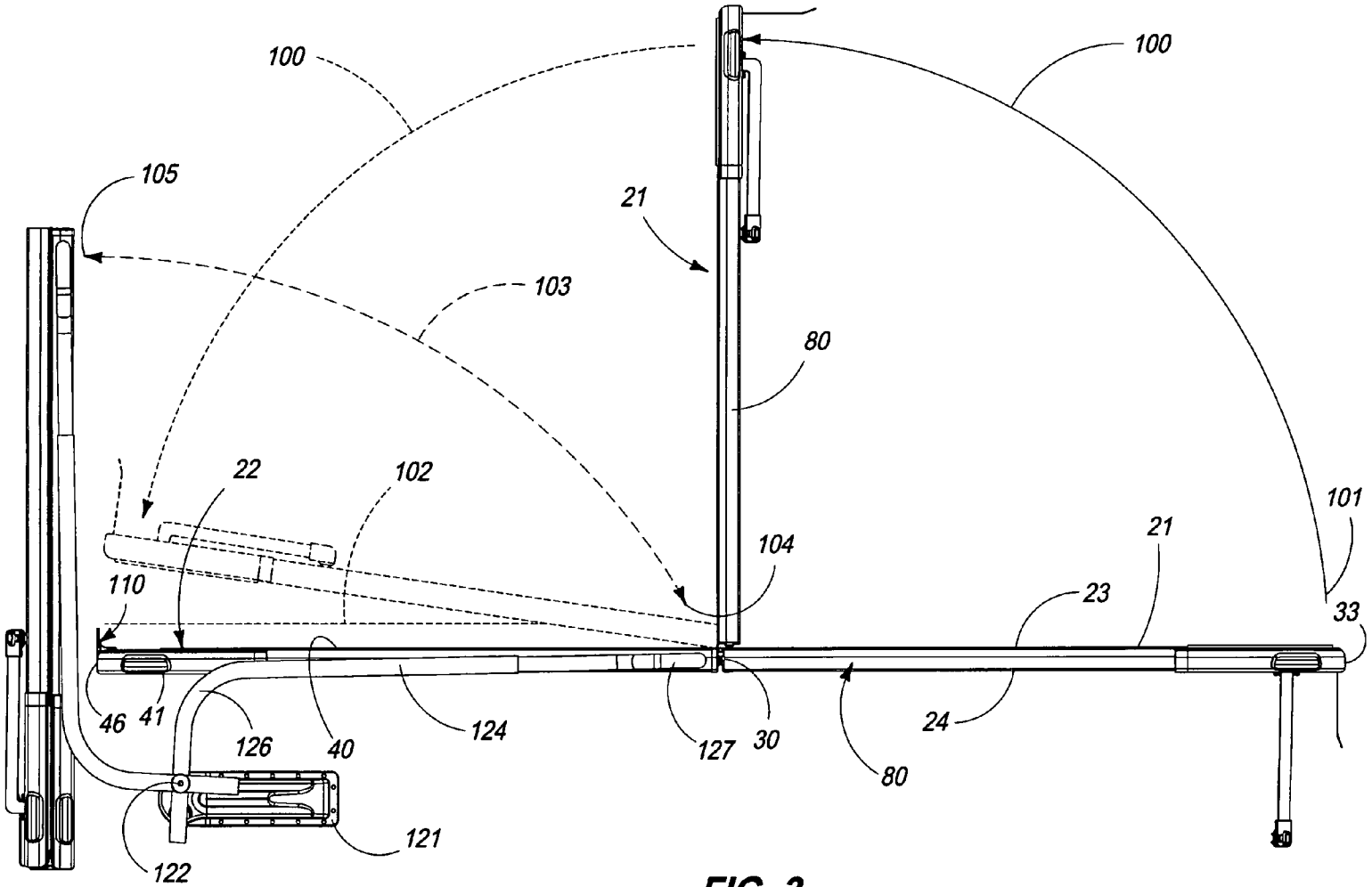
FIG. 3 is a side elevation view of the spa cover of the present invention.

As can be seen from the drawings, and more specifically by reference to FIG. 3, the hinge 90 facilitates the movement of the first and second portions 21 and 22 along an arcuately shaped path of travel which is generally indicated by the numeral 100, and between a first position 101, and wherein the first and second portions 21 and 22 are horizontally positioned, and substantially co-planar, one relative to the other so as to substantially occlude the spa cavity 16, and otherwise cover the spa 11 to prevent access. The first portion 21 is operable to move along the path of travel 100, to a second position which is generally indicated by the numeral 102 as seen in FIG. 3. In the second position 102, the first portion 21 is disposed in a juxtaposed substantially parallel relationship relative to the second portion 22, and the underlying spa 11 is at least partially exposed. Still further, the first and second, portions 21 and 22 are movable, in unison together along a second arcuately shaped path of travel 103, from a first position 104, and wherein the first and second portions 21 and 22 are in a substantially horizontal, and parallel orientation, and then are movable, in unison, along the second path of travel 103, to a second position 105, and wherein both first and second portions 21 and 22 are substantially vertically oriented, and the underlying spa 11, is substantially completely uncovered and ready for the enjoyment of the user 17.

Figure 5:
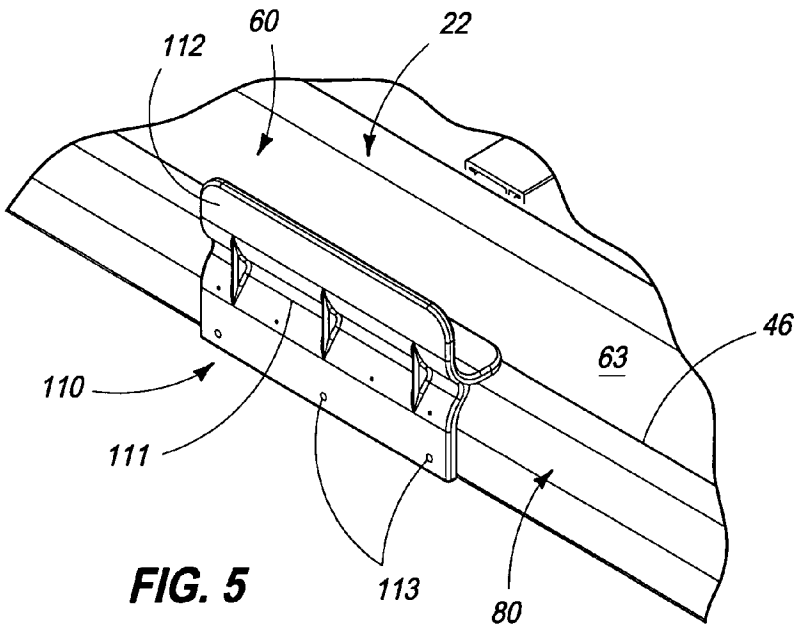
FIG. 5 is a greatly enlarged, fragmentary perspective view of another feature of the spa cover of the present invention.

To facilitate the movement of the first and second portions 21 and 22 and to enhance the reliability and usefulness of the spa cover 10, a support member 110 is provided, and which is mounted on the outwardly disposed peripheral edge 46 of the second portion 22, and substantially centrally thereof. This is best seen by reference to FIGS. 2 and 5. The support member 110 has a main body 111 forming a curved receiving member 112, and which has a curvature which is somewhat substantially similar to the curvature as provided for by the peripheral edge cover 80 which is affixed to the outwardly disposed peripheral edge 33 of the first spa portion 21. As will be readily understood by a study of FIG. 3, the curved receiving member 112 is operable to matingly support and otherwise cooperate with the peripheral edge of the first spa cover 21 and thereby support the weight thereof when the first and second portions 21 and 22 are in a vertical position, and at the second position 105 along the second path of travel 103. The support member 110, of course, takes the majority of the weight of the first portion 21 and thereby relieves the continuous flexible hinge 90 of any substantial force attributed to the weight of the first portion 21. The main body 111 is attached to the outside peripheral edge 46 by means of fasteners 113 as seen in FIG. 5.

The spa cover 10 of the present invention is operable to move along the arcuately shaped paths of travel 100 and 103, respectively, by means of the U-shaped carrier which is generally indicated by the numeral 120. The U-shaped carrier is very similar in its overall design and operation to that seen in U.S. Pat. No. 5,996,137, the teachings of which are incorporated by reference herein. In particular, the U-shaped carrier 120 is supported for rotational movement on the spa 11 by means of a pair of brackets 121, which are mounted on the spa, and which define a lift axis 122 when the first and second portions 21 and 22 of the spa cover 10 are moving in unison from a substantially horizontal orientation, where the respective spa covers 21 and 22 partially cover the spa 11, to a substantially vertical orientation when the spa 11 is completely exposed. This is best seen by reference to FIG. 3. The pair of brackets 122 are fastened to the spa 11 by means of a multiplicity of fasteners as was described in this earlier patent. The U-shaped carrier is formed of a pair of substantially parallel support arms which are coupled to a cross-member 125 which is received in, and through, one of the multiplicity of rigid tongue and groove hollow synthetic board 60 which form the second portion 22 of the spa cover 10. This is best seen by reference to FIGS. 3 and 4, respectively. The cross-member 125 has a length dimension which is greater than the length dimension of the respective synthetic boards 60 making up the second portion 22 of the spa cover. Still further the parallel support arms 124 have end extensions 126 which otherwise curve or bend downwardly, and the distal end thereof is mounted for rotational movement about the lift axis 122 in the manner as described in the aforementioned patent. The portion of the respective parallel support arms 124 closest to the distal ends of the cross-member 25 provides a convenient hand grip 127 for the user 17 to exert force so as to cause the first and second portions 21 and 22 to move along the second path of travel as earlier described. This is seen most clearly by reference to FIG. 1.

Operation

The operation of the described embodiment of the present invention 10 is believed to be readily apparent and is briefly summarized at this point. In its broadest aspect, the present invention relates to a spa cover 10, and which includes first and second rigid and substantially fluid and permeable portions 21 and 22, and where each of these portions have peripheral edges 25 and 42, respectively, and which are moveably joined to each other along one of their respective peripheral edge portions 30 and 43, by a continuous hinge 90. Each portion of the spa cover 21 and 22 defines a multiplicity of spaced, uniformly elongated internal channels 34 and 47 which extend between a pair of opposed peripheral edges. The spa cover 10 further includes individual, lightweight, unitary, insulative inserts 70 which are conformingly dimensioned for telescoping receipt within each of the elongated internal channels 34 and 47 which are defined by the respective first and second portions 21 and 22 of the spa cover 10. The spa cover 10 further includes a pair of brackets 121 which are mounted on a spa 11 and which define, at least in part, a course of travel 101 at 103 for the first and second portions of the spa cover 21 and 22, as the first and second portions 21 and 22 move in substantial unison together to expose the spa 11 for use. Finally, the spa cover 10 includes a generally U-shaped carrier 120 which is rotatively affixed to the pair of brackets 121, and which cooperates with the second portion 22 of the spa cover, and wherein the U-shaped carrier carries the first and second portions 21 and 22 of the spa cover 10 along the course of travel 103, and which permits the underlying spa 11 to be exposed for use. In the arrangement as seen in the drawings, the individual peripheral edge covers 80 matingly cooperate with the peripheral edges 25 and 42, respectively, of the first and second portions 21 and 22, and which sealably secure the individual insulative inserts 70 in the elongated internal channels 34 and 47 as previously described. In the arrangement as seen in the drawings, a pair of seals 36 and 49 respectively are mounted on the respective first and second portions 21, and 22, of the spa cover 10 and which sealably engage the underlying spa 11 when the respective portions 21 and 22 of the spa cover are positioned in a horizontal co-planar and, abutting orientation, one relative to the other. In the arrangement as seen in the drawings, the first and second portions 21 and 22 are fabricated from a multiplicity of rigid, tongue and groove shaped, hollow, synthetic and fluid impermeable boards 60 which are affixed together to form the respective first and second portions 21 and 22. The respective first and second portions 21 and 22 can support a weight of at least about 112 pounds per square foot inch of surface area. In the present invention 10, the respective insulated inserts 70 are fabricated from a synthetic, closed pore foam material which substantially resists the absorption of water. Further, the spa cover 10 has an insulative R rating of greater than about 8. In the arrangement as seen in the drawings, the first and second portions 21 and 22 have an abutting peripheral edge 30 and 43. The continuous hinge 90 is attached to each of the abutting peripheral edges. The spa cover 10 further has a seal 93 which is mounted on each of the abutting peripheral edges, and which is operable to engage the peripheral edge of the adjacent spa portion when the respective spa portions are located in a substantially co-planar orientation, one relative to the other. In the preferred embodiment, a support member 110 is borne by the second portion 22 of the spa cover and which is operable to support, at least in part, the weight of the first portion 21 of the spa cover 10 when the respective spa cover portions 21 and 22 are each oriented in a substantially vertical orientation 105 as seen in FIG. 3 of the drawings.

Therefore, it will be seen that the present spa cover 10 of present invention provides a convenient means for covering an underlying spa 11 in a fashion not possible, heretofore. Further, the spa cover 10, because of its rigid construction, provides many advantages over the prior spa covers fabricated in the past, and in particular it substantially resists any absorption of water, or water vapor, coming from both the underlying spa or the ambient environment, thereby preventing the spa cover 10 from becoming increasingly heavier over time, and thereby resists the growth of mold, bacteria and the like which is attendant to such moist environments. Further, the construction of the spa cover 10 is such that it insulates the underlying spa 11, and prevents the loss of heat energy from same, therefore making the spa more economical to operate. Additionally, the construction of the rigid spa cover 10 is of a type such that it is lightweight, and is able to be easily moved to a position where the spa is rendered operational by an individual of average strength.

In compliance with the statute, the invention has been described in language more or less specific as to structural and methodical features. It is to be understood, however, that the invention is not limited to the specific features shown and described since the means herein disclosed compromise preferred forms of putting the invention into effect. The invention is, therefore, claimed in any of its forms or modifications within the proper scope of the appended claims appropriately interpreted in accordance with the Doctrine of Equivalents.

I claim:

1. A spa cover, comprising:

a first and second rigid, fluid impermeable portion, and which each have a peripheral edge, and wherein the respective first and second portions are each hingedly joined to each other along a portion of each of their respective peripheral edges, and wherein the first and second portions are each assembled from a multiplicity of rigid, tongue and groove shaped, hollow, synthetic, and fluid impermeable boards which are affixed together, and which each have opposite first and second ends, and wherein the first and second ends define apertures which permit access to a hollow, narrowly elongated internal channel which extends between the opposite, first and second ends, and wherein the first and second rigid, fluid impermeable portions that are formed from the multiplicity rigid, tongue and groove shaped boards has a predetermined, upwardly facing surface area, and wherein the multiplicity of rigid tongue and groove shaped, and hollow synthetic boards, when formed into the first and second fluid impermeable portions, has a strength which can repeatedly support a weight of at least 112 pounds per square foot when this weight is downwardly applied to the upwardly facing surface area, without permanently deflecting and distorting the first and second rigid fluid impermeable portions;

a multiplicity of individual, light-weight insulative inserts, and which are formed from a closed pore, fragile, insulative material which substantially resists the absorption of water, and wherein the respective insulative inserts are telescopingly received within the respective, narrowly elongated internal channels of each of the rigid, tongue and groove shaped fluid impermeable boards, and wherein the individual, light-weight insulative inserts substantially occlude the respective internal channels defined by the respective fluid impermeable boards;

a peripheral edge cover which is removably mounted on, and extends along at least a portion of the peripheral edge of the respective first and second portions of the spa cover, and which sealably covers, and prevents immediate access to, and the movement of air into, or out of, the narrowly elongated, internal channels which individually extend between the opposite, first and second ends of each of the rigid tongue and groove shaped fluid impermeable boards, and wherein the peripheral edge cover is removable to permit the subsequent removal, and the replacement of the respective light-weight insulative inserts when the respective light-weight insulative inserts become ineffective;

a hinge coupled to each of the respective first and second portions of the spa cover, and wherein the hinge facilitates the movement of the first portion relative to the second portion so as to facilitate an exposure of an underlying spa which is located below the spa cover, and wherein the spa has opposite sides;

a generally U-shaped carrier having a centrally disposed cross-member which is located in a predetermined, spaced, closely adjacent relationship relative to the hinge, and within at least one of the elongated internal channels which are defined by the second portion of the spa cover, and is not located in physical contact with the hinge, and wherein the generally U-shaped carrier has opposite distal ends which are located outside of the elongated internal channel which is defined by the second portion of the spa cover, and which receives the centrally disposed cross-member, and wherein the respective distal ends of the U-shaped carrier are oriented in spaced relation relative to the opposite sides of the spa; and a pair of brackets which are mounted on the opposite sides of the spa, and which define a lift axis for the spa cover when the spa cover is moved from a position in covering relation relative to the spa, to a location where the underlying spa is exposed for subsequent use, and wherein the opposite, distal ends of the generally U-shaped carrier are individually, pivotally affixed to each of the respective brackets at the lift axis, and wherein the centrally disposed cross-member of the U-shaped carrier does not retard the movement of the first fluid impermeable portion relative to the second fluid impermeable portion as the underlying spa is being exposed.

2. A spa cover as claimed in claim 1, and further comprising:

a seal mounted on the respective first and second portion of the spa cover, and which sealably engages the underlying spa when the first and second portions of the spa cover are located in a horizontal, coplanar, and abutting orientation, one relative to the other, and when the spa cover is located in covering relation relative to the underlying spa.

3. A spa cover as claimed in claim 1, and wherein the spa cover has an insulative R rating of greater than 8.

4. A spa cover as claimed in claim 1, and wherein the first and second portions of the spa cover each have an abutting peripheral edge, and wherein the hinge is attached to each of the abutting peripheral edges, and wherein the spa cover further comprises a seal mounted on each of the abutting peripheral edges and which sealably engage each other when the respective first and second portions of the spa cover are located in a horizontal, coplanar orientation, one relative to the other, and in covering relation relative to the underlying spa.

5. A spa cover as claimed in claim 1, and further comprising:

a support member mounted on the second portion of the spa cover, and which supports, at least in part, a weight of the first portion of the spa cover when the respective portions of the spa cover are oriented substantially vertically, and in parallel relation, one relative to the other.

* * * * *